US006604311B1

(12) United States Patent
Laney et al.

(10) Patent No.: US 6,604,311 B1
(45) Date of Patent: Aug. 12, 2003

(54) LEVER-OPERATED BREECHBLOCK FOR MUZZLE-LOADING FIREARM

(75) Inventors: Mark C. Laney, Lee, NH (US); Karl K. Ricker, Somersworth, NH (US); Gordon R. Cate, Stratham, NH (US)

(73) Assignee: Thompson Intellectual Properties, Ltd., Rochester, NH (US)

( * ) Notice: Subject to any disclaimer, the term of this patent is extended or adjusted under 35 U.S.C. 154(b) by 0 days.

(21) Appl. No.: 10/269,286

(22) Filed: Oct. 12, 2002

(51) Int. Cl.[7] ..... F41A 19/00
(52) U.S. Cl. ..... 42/51; 42/34
(58) Field of Search ..... 42/26, 28, 23, 42/34, 51, 83, 27

(56) References Cited

U.S. PATENT DOCUMENTS

| | | | | | |
|---|---|---|---|---|---|
| 14,491 | A | * | 3/1856 | Burnside | 42/27 |
| 17,223 | A | * | 5/1857 | Read | 56/157 |
| 42,702 | A | * | 5/1864 | Trulender | 42/27 |
| 212,593 | A | * | 2/1879 | Deeley et al. | 42/23 |
| 214,098 | A | * | 4/1879 | Buck | 42/34 |
| 250,495 | A | | 12/1881 | Burnett | |
| 261,648 | A | * | 7/1882 | Altmaier | 42/34 |
| 291,153 | A | * | 1/1884 | Cole | 42/23 |
| 939,142 | A | | 11/1909 | Lewis | |
| 1,059,477 | A | | 4/1913 | Lewis | |
| 1,157,656 | A | * | 10/1915 | Swebilius et al. | 42/23 |
| 1,448,297 | A | * | 3/1923 | Hedrick | 42/23 |
| 1,459,108 | A | | 6/1923 | Lewis | |
| 1,494,105 | A | * | 5/1924 | Elder | 42/34 |
| 1,790,482 | A | * | 1/1931 | Mossberg | 42/28 |
| 1,795,111 | A | * | 3/1931 | Dygert | 42/34 |
| 2,627,687 | A | | 2/1953 | Arbuckle | 42/34 |
| 3,526,051 | A | * | 9/1970 | Greco et al. | 42/28 |
| 4,452,001 | A | * | 6/1984 | Compton | 42/23 |
| 4,854,065 | A | | 8/1989 | French et al. | 42/65 |
| 5,435,089 | A | | 7/1995 | Rodney | 42/51 |
| 5,680,722 | A | | 10/1997 | French et al. | 42/69.03 |
| 5,907,920 | A | | 6/1999 | Laney | 42/83 |
| 6,145,235 | A | * | 11/2000 | Emerson et al. | 42/90 |
| 6,305,113 | B1 | * | 10/2001 | Calvete | 42/51 |
| 6,314,670 | B1 | * | 11/2001 | Rodney, Jr. | 42/51 |

* cited by examiner

*Primary Examiner*—Michael J. Carone
*Assistant Examiner*—Denise J Buckley
(74) *Attorney, Agent, or Firm*—Hans A. Stoeckler

(57) ABSTRACT

A muzzle-loading firearm with a lever-operated breechblock pivotally movable between a securely locked closed position to an open position to expose in plain view a removable breech plug having a cavity for receiving a primer, detonation of which causes ignition of a powder charge in the muzzle loader barrel. The breechblock and a lever are pivotally mounted on a rearward barrel lug which is attached to the barrel. The lever is operatively connected to the breechblock by a pivotally mounted link. The pivotal link in an angular position exerts a locking force on the closed breechblock. The lever manually moves the breechblock rearwardly and downwardly to an open position. A firing mechanism assembly, including a trigger, hammer, firing pin, and torsional springs for forwardly biasing the trigger and hammer, is a unitary member of the rotating breechblock structure.

15 Claims, 11 Drawing Sheets

LEVER-OPERATED BREECHBLOCK FOR MUZZLE-LOADING FIREARM

BACKGROUND OF THE INVENTION

1. Field of the Invention

The present invention relates generally to muzzle-loading firearms in which a rotatable breechblock is pivotally mounted on a rearward barrel lug at the breech-end of the muzzle loader firearm enabling a combined triggerguard and lever to move the breechblock rearwardly and downwardly from a securely locked closed firing position to an open priming position by a pivotal link operationally connecting the guard lever to the breechblock. The prior art of the present invention includes the class of 42/34 and 42/51.

2. State of the Prior Art

In the present invention, the movement of the breechblock between its closed locked position and its open position exposes a screwably removable breech plug for receiving a primer. The breech-loading action of the present invention provides a comfortable and safe operation equally for left-handed and right-handed shooters of muzzle-loading firearms. The guard lever of the present invention has an interlock safety which engages a curved blade portion of the trigger preventing the firing of the firearm unless the breechblock is in its fully locked position. In the present invention, a trigger mechanism utilizes a hammer block as an extended part of the trigger thereby providing an automatic hammer block safety. The firing mechanism of the present invention is self-contained in the pivotal breechblock as a unitary structure.

Prior art of swinging block actions of class 42/26 or falling block actions of class 42/23 comprise pivotal toggle-link systems that lock the breechblock in the firing position and that lower the breechblock after firing were difficult to manufacture and to assemble because of the high precision required to minimize mechanical play inherent in breech-loading actions having a plurality of moving pins, joints, and links. Prior art of muzzle-loading firearms, having bolt-actions and break-open actions with breech plugs for utilizing primers, are inherently more cumbersome and less safe to operate than the present invention. In other muzzle-loading firearms having mounted scopes near the bolt-action fire mechanisms, the operations of priming, the removal of fired primers, the cleaning, and the maintenance is particularly difficult because the breech plug is much less accessible. A muzzle-loading firearm of the prior art, having bolt-action or break-open action mechanisms, requires the removal of the barrel from the frame and other disassembly of moving parts before the breech plug becomes accessible for cleaning and maintenance. The sport enthusiast prefers the simple and convenient firing mechanism of a breech-loading cartridge rifle but also seeks the classical character of the muzzle-loading firearm. The present invention overcomes the disadvantages that are inherent in breech-loading actions for muzzle-loading firearms of prior art and, at the same time, offers the sport enthusiast the simplicity and inexpensive convenience of a lever-operated breechblock by utilizing an improved linkage design for locking it in its firing position. The most distinctive improvement of the present invention is a lever-operated breechblock containing a firing mechanism assembly mounted therein as a unitary structure with a provision of pivotally moving the breechblock from its securely locked position to its open position for making the firearm readily accessible for safe loading of the primer, easy and safe extraction of the detonated primer, easy removal of the breech plug, and easy disassembly of the firearm for safe maintenance, cleaning, and inspection.

The object of the present invention is a provision for a firearm having an easy and safe operation and fewer moving parts resulting in simple construction, an economical method of manufacture, and a long life of useful service.

A further object of the present invention is a provision for a muzzle-loading firearm having a shorter breech assembly thereby making it possible to utilize a longer muzzle. It is well known to those skilled in the art that a longer muzzle will produce a higher projectile speed and, hence, an increased projectile accuracy at a greater range.

Another object of the present invention is a provision for a firearm having a direct sight and accessibility of the breech plug and an easier, more convenient, faster, and safer method of readily inserting and properly seating a primer into, and extracting a detonated primer from, said breech plug without using a specialized tool for such an operation.

It is another object of the present invention to provide an easier, more convenient, faster, and safer means of readily removing the breech plug without disassembling either the firearm, or the firing mechanism assembly, or the breech assembly.

It is a further object of the present invention to incorporate an automatic hammer block safety and an interlock safety on the trigger making a manual on/off safety redundant. By incorporating a readily removable breech plug in the new sealed breech assembly, a manner of safe storage of the rifle is available by safely storing the removed breech plug in a separate location from the firearm.

Another useful improvement of this invention is that once the breech plug is removed, a straight view access passage extending longitudinally from the breech to the ignition chamber in the barrel is available and it becomes possible to extract either an unfired powder charge, or a combined powder charge-projectile, through the breech-end of the barrel by inserting a ramrod into the muzzle-end of the barrel and pushing the ramrod towards the rear until the powder charge, or the combined powder charge-projectile, has completely exited through the open breech-end of the firearm.

A further object of the present invention is a provision for a sealed and weatherproof breech when the breechblock is in its securely locked position for minimizing the risk of hangfire and/or misfire.

Another object of the present invention is that the sealed breech prevents the hot exhaust gases from the detonated primer to be released in the proximity of the shooter.

A further object of the invention is a provision for preventing an accidental firing when the hammer mechanism is in the cocked, ready-to-fire, position and the breechblock is in its open position.

A still further object of the invention is a provision of a firearm wherein the breechblock is prevented from moving to its open position when the hammer is in its cocked position.

It is another object of the present invention to provide a firearm in which the hammer is prevented from being moved to its cocked position while the breechblock is in its open position.

With these and other objects in view, as will be apparent to those skilled in the art, the invention resides in the combination of parts set forth in the specification.

SUMMARY OF THE INVENTION

In general, the invention consists of a muzzle-loading firearm having a barrel, a pivotally rotating breechblock, in combination a trigger guard and a pivotally rotating lever connected to the breechblock by a pivotally mounted linkage, a removable breech plug with a cavity for receiving a primer at the breech-end of the barrel, a firing mechanism assembly for detonating the primer comprising a trigger pivotally mounted on the breechblock and having a rearwardly attached curved tongue, a pivotally mounted torsion spring for forwardly biasing the trigger, a hammer block fixed to the trigger as an upward extension, a hammer which is pivotally mounted on the breechblock and is forwardly biased by a torsion spring, and a firing pin slidably mounted in the breechblock and axially aligned with the primer-receiver chamber and the bore of the barrel. The firing mechanism assembly is a unitary member of the breechblock structure. The breechblock rotates pivotally rearwardly and downwardly from its closed position to its open position by the manual operation of the lever. At a relative angular over-the-center lock position of the link, with reference to the center of the lever pivot pin, the breechblock is securely locked against the breech-end of the barrel by forces exerted by the connective link. The hammer block extends from the pivot point of the trigger to a position in which it blocks the hammer from reaching its forward firing position when the trigger is in its forward neutral position. The hammer in its intermediate neutral position, acting through the hammer block, prevents the trigger from being moved rearwardly from its forward neutral position. When the hammer is moved to its rearward cocked position, it causes the trigger to move from its forward neutral position to an intermediate ready-to-fire position. Thereafter, the trigger can be pulled to its rearward position to release the cocked hammer to its forward firing position for engaging the firing pin only when the breechblock is securely locked by the connective link, The curved tongue portion of the trigger engages an interlock pin on the triggerguard and prevents the firing of the muzzle-loading firearm when the breechblock is in the open position.

BRIEF DESCRIPTION OF THE DRAWINGS

The character and attributes of the invention may be best understood by reference to one of its structural forms, as more particularly illustrated by the accompanying drawings, in which.

DETAILED DESCRIPTION OF THE DRAWINGS

Figure 1:
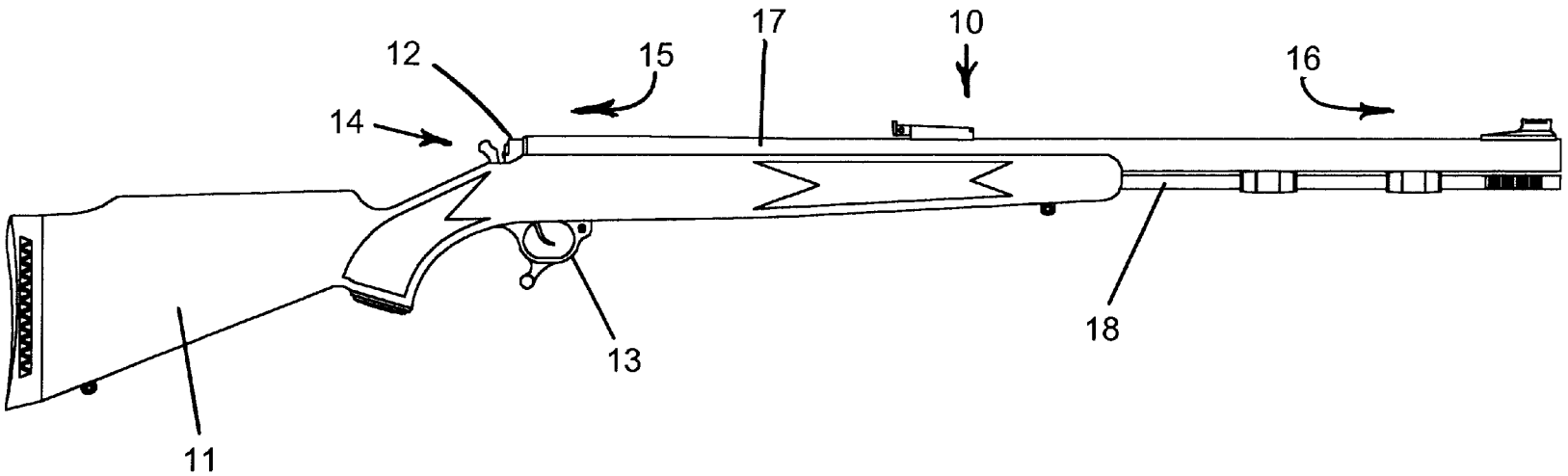
FIG. 1 is a vertical side elevational view of a muzzle loading firearm embodying the principles of the present invention.
Figure 2:
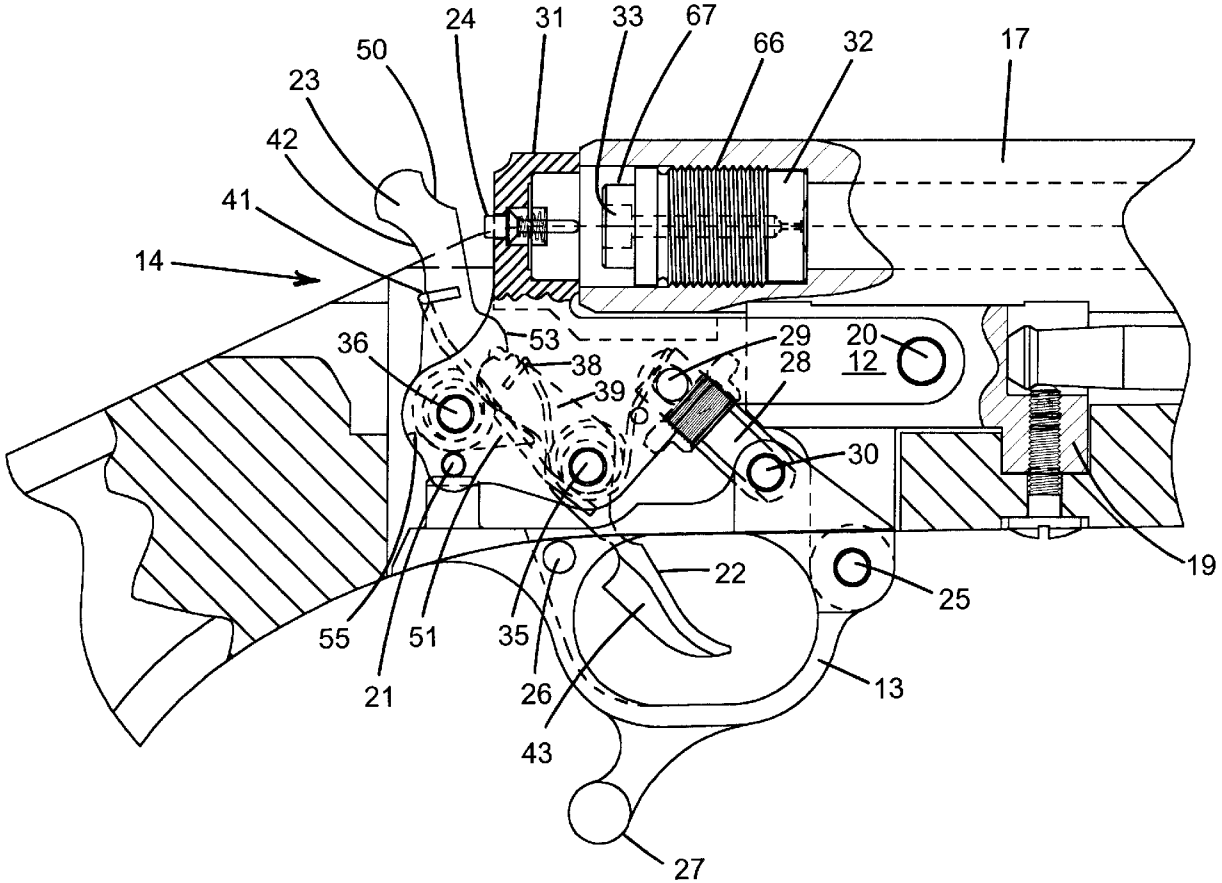
FIG. 2 is a longitudinal vertical fragmentary right side elevational view of the muzzle-loading firearm with portions broken away and showing the breechblock closed and locked, showing the hammer in the neutral intermediate position, and showing the trigger in the neutral forward position.
Figure 5:
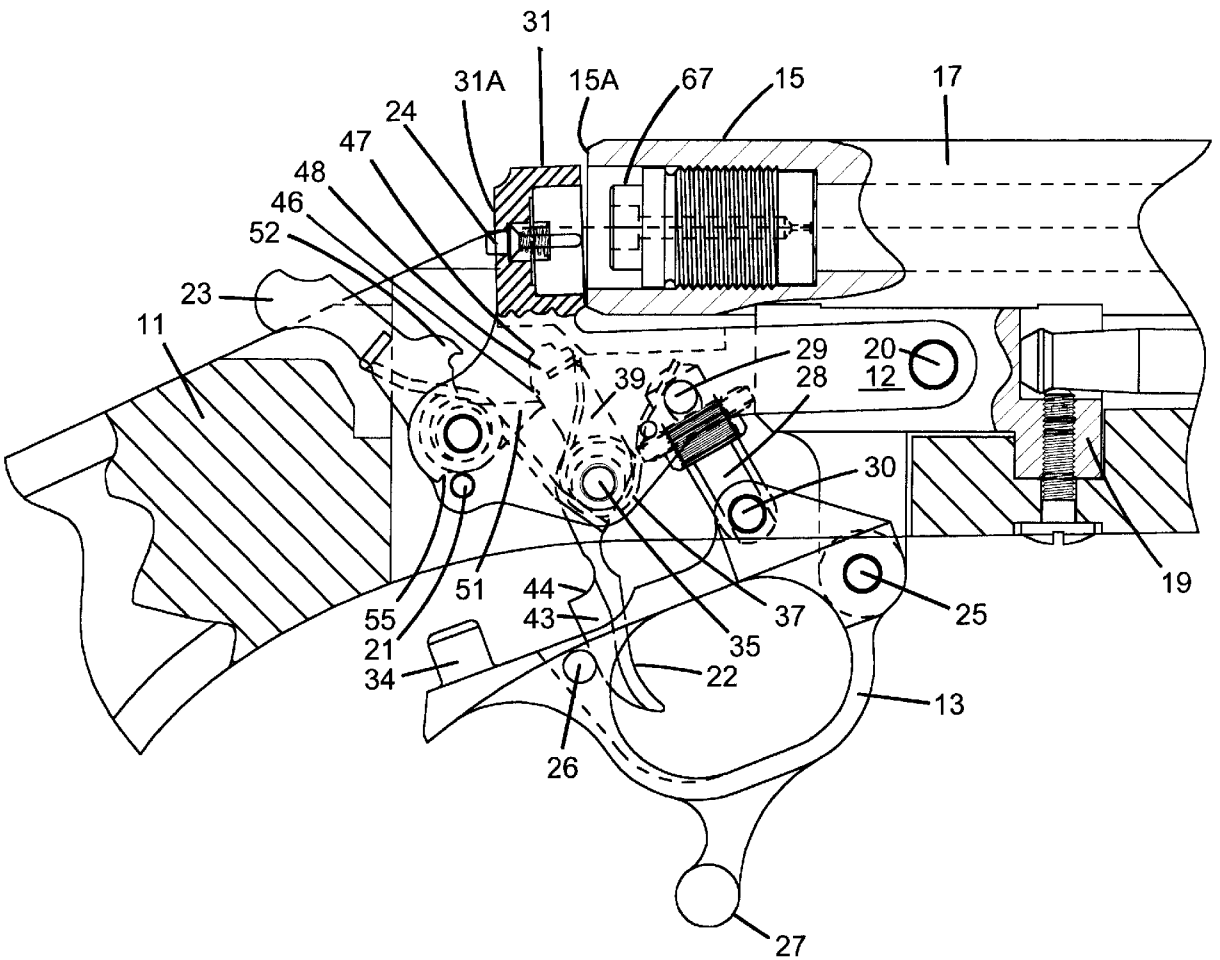
FIG. 5 is a view similar to FIG. 2 showing the breech in its partially open position when the curved tongue of the trigger blade is engaged against the lever interlock pin thereby preventing the hammer from being cocked.
Figure 6:
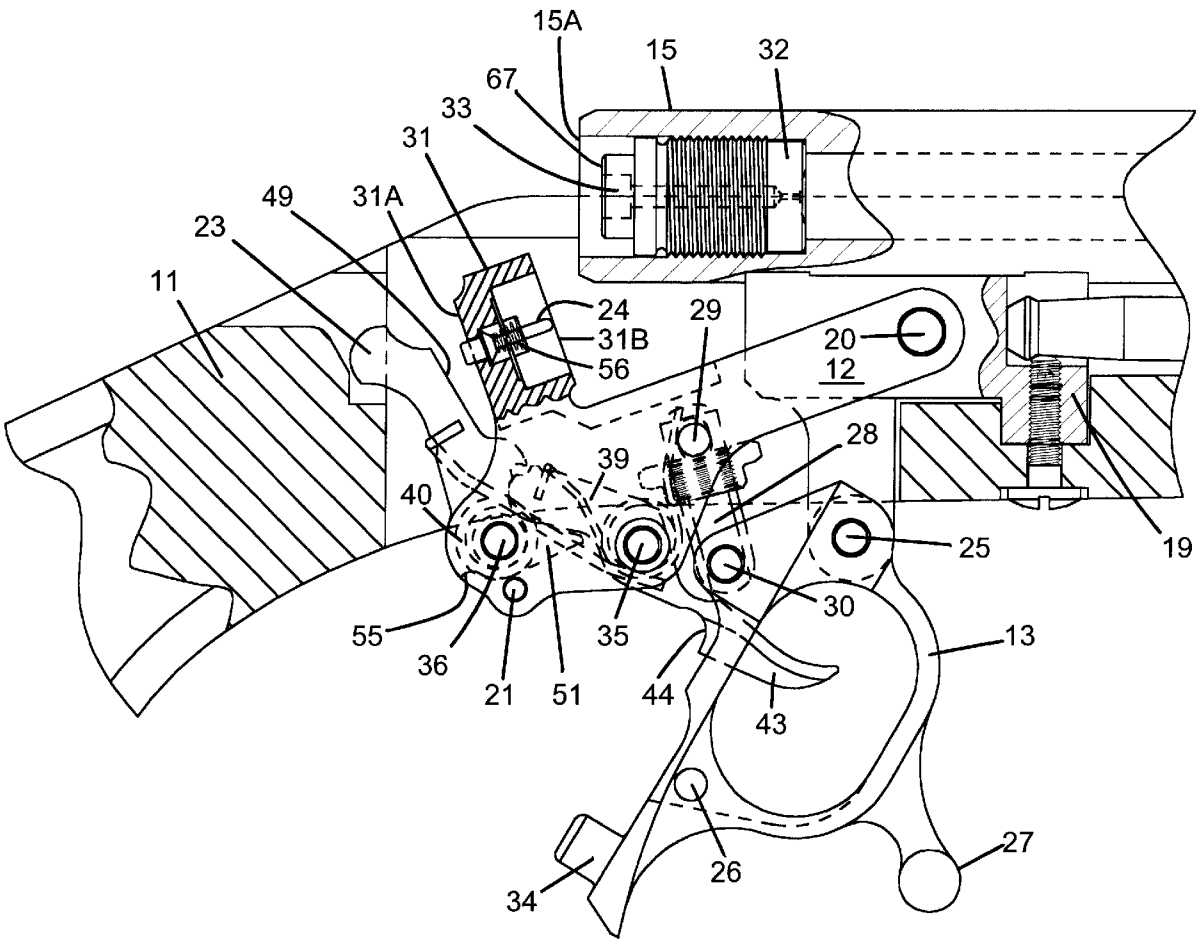
FIG. 6 is a view similar to FIG. 2 showing the breech in its fully open position ready to load a primer into the primer-receiving chamber of the breech plug and showing the hammer and the trigger in their neutral position.

Referring first to FIG. 1, a muzzle-loading firearm of the present invention is generally indicated by the reference numeral 10. The firearm 10 comprises a stock 11 and a barrel 17 having a breech-end 15 and a muzzle-end 16, and a bore therethrough. A ramrod 18 for facilitating the conventional loading of powder and projectile into the muzzle-end 16 of barrel 17 is stored in the firearm 10. Referring to FIG. 2, the muzzle-loading firearm 10 incorporates in the breech-end 15 a removable breech plug 32 having a rearward cavity 33. The muzzle-loading firearm incorporates a pivotally rotating breechblock 12 and in combination a trigger guard and a pivotally rotating lever 13. A firing mechanism, generally indicated by the reference numeral 14, is incorporated as a unit assembly in the rotatable breechblock 12. A rear main barrel lug 19 is attached to the barrel 17. The breechblock 12 is pivotally connected to the barrel lug 19 by horizontal pivot pin 20. The breechblock 12 is rotatable rearwardly and downwardly between a securely locked closed position, as shown in FIG. 2, a partially open position, as shown in FIG. 5, and a fully open position, as shown in FIG. 6. When the breechblock is in the open position, the rearward cavity 33 is accessible for loading and unloading a primer. The lever 13 is pivotally connected to the barrel lug 19 by a horizontal pivot pin 25. The breechblock 12 and the lever 13 are operatively connected by a lever-follower link generally indicated by a reference numeral 28. A horizontal pivot pin 29 mounts link 28 on the breechblock 12. A horizontal pivot pin 30 mounts link 28 on the lever 13. An embodiment of the present invention includes a nonadjustable link of the type shown in FIG. 7A. Another embodiment of the present invention includes adjustable lever-follower links of the type shown in FIGS. 7B and 7C. Link 28 maintains an optimum predetermined distance between the pivot pin 29 and the pivot pin 30. A finger grip 27 on the lever 13 enables manual movement of the lever about the pivot pin 25. Link 28 follows the downward and forward lever movement thereby causing the breechblock 12 to rotate rearwardly and downwardly about pivot pin 20 from the locked closed position toward the open position away from the breech 15, as shown in FIG. 6. Link 28 follows the rearward and upward lever movement thereby causing the breechblock 12 to rotate upwardly and forwardly from the open position toward the securely locked closed position, as shown in FIG. 2. The upward and rearward closing movement of the lever 13 causes the connective link 28 to transmit a variable compressive and tensile force on the breechblock 12 as link 28 rotates through a maximum excursion along its length thereby causing the breechblock to be securely locked in the closed position.

Figure 3:
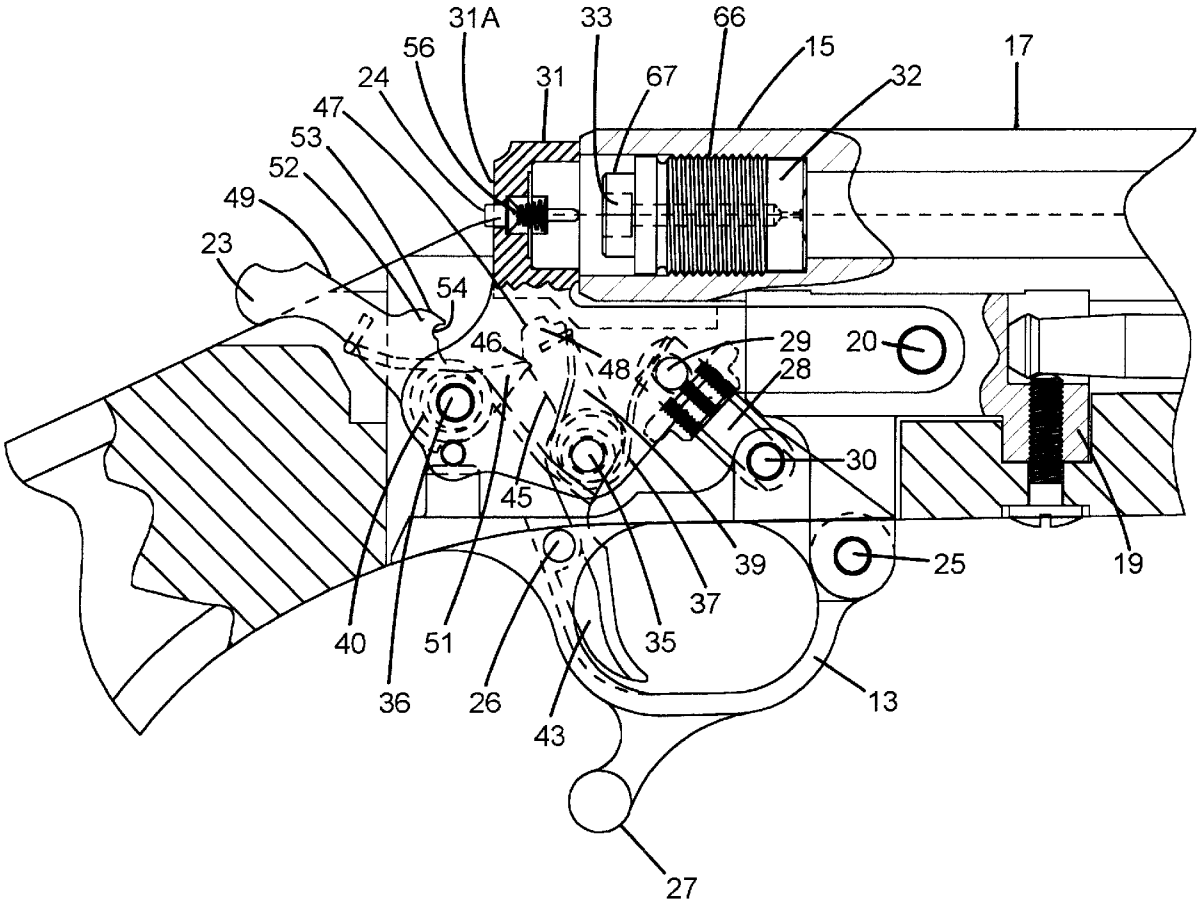
FIG. 3 is a view similar to FIG. 2 showing the firing mechanism assembly and the hammer in the cocked, "ready-to-fire", position and showing the trigger in the intermediate position.

Referring to FIGS. 2–6, the firing mechanism assembly is mounted as a unitary structural member on the breechblock and comprises in combination a trigger 22 and an upwardly extending hammer block (sear) 39, a hammer 23 having an actuator finger 51, and a firing pin 24. The trigger 22 and the hammer 23 are rotationally mounted on the breechblock 12 as a cooperatively communicating unit structure. The firing pin 24 is slidably mounted along its central longitudinal axis in a housing 31 of the breechblock 12. The trigger 22 is pivotally connected to the breechblock 12 by a horizontal pivot pin 35. The hammer 23 is connected to the breechblock by a horizontal pivot pin 36. The hammer 23 has a thumb grip 50 for manually moving the hammer 23 rearward about the pivot pin 36 from the intermediate neutral position to the cocked position. The trigger 22 is biased forwardly by a torsion spring 37 having innerconnected corresponding ends. The centrum of the torsion spring 37 is pivotally mounted on the pivot pin 35 with the convolution of the spring disposed in opposite sides of the trigger. One end of the torsion spring 37 acts on the forwardly facing upper end of the hammer block 39 and is connected to a forwardly facing notch 38 on the upper end of the hammer block 39. The other end of the torsion spring 37 is connected to, and acts on, the pivot pin 29. The hammer 23 is biased forwardly by a torsion spring 40 having innerconnected corresponding ends. The centrum of torsion spring 40 is pivotally mounted on the pivot pin 36 with the convolution of the spring disposed in opposite sides of the hammer. One end of the torsion spring 40 acts on the rear face 42 of the hammer and is connected to a rearwardly facing notch 41 above the pivot pin 36. The other end of the torsion spring 40 is connected to, and acts on, the pivot pin 35. Referring to FIG. 6, the hammer 23 has a forwardly facing striking surface 49 which is in line with the firing pin 24. The firing pin 24 is rearwardly biased by a helical compression spring 56. The force exerted by the torsion spring 40 when the hammer is released for movement to a firing position is sufficient to move the firing pin 24 forwardly to effect firing of the primer in the rearward cavity 33 in breech plug 32. The hammer block 39 normally occupies a rearward position when the trigger 22 is in its forward neutral position, as shown in FIG. 2. Referring to FIG. 3, the hammer block 39 has a rearwardly facing surface 45 which has a rearwardly facing notch (sear ledge) 46. The upper end of the hammer block 39 has a rounded surface 47 and a lip 48 for limiting the rearward movement of the trigger when the firearm 10 is in the neutral position, as shown in FIG. 2.

Figure 4:
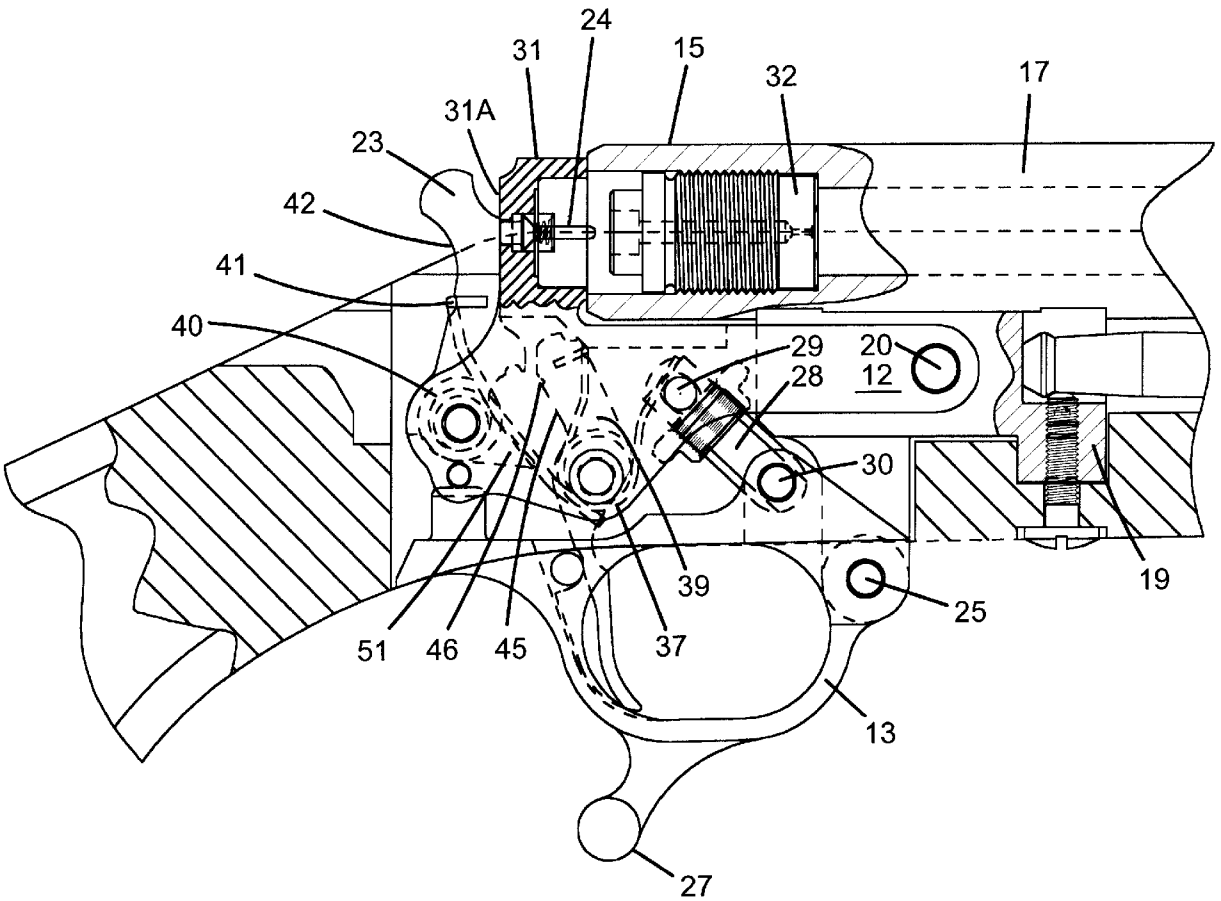
FIG. 4 is a view similar to FIG. 2 showing the hammer in the firing position and showing the trigger in the most rearward position when the striker surface of the hammer contacts the complementary rearward surface of the firing pin housing of the breechblock.

The firing pin 24 is in axial alignment with the primer and the striking surface 49 of the hammer 23 when the breechblock 12 and the barrel 17 is in the locked position, as shown in FIG. 2. The firing pin housing 31 has a rearward surface 31A for receiving the complementary striking surface 49 of the hammer 23 in the firing position and a forward lock surface 31B for sealing on a complementary lock surface 15A of the breech-end 15 when the breechblock 12 is in the fully closed position. The rearward end of the rearwardly biased firing pin 24 extends beyond a rearward surface 31A of the housing 31 of the breechblock 12 when the firearm 10 is in neutral position, as shown in FIG. 2. Referring to FIG. 4, the forward portion of firing pin 24 extends forwardly to the breech plug 32 when the firearm 10 is in its firing position.

Referring to FIG. 2 and FIG. 3, when the hammer 23 is in its intermediate neutral position, it is spaced away from the firing pin 24. The actuator finger (hammer catch) 51 extends below the pivot pin 36 when the hammer 23 is in its intermediate neutral position and is in contact with the rearwardly facing surface 45 of the hammer block 39. A retaining finger 52 is also integral with the hammer 23 and extends forwardly above the hammer block 39 when the hammer 23 is in the intermediate neutral position. The retaining finger 52 has a rounded surface 53 at its forward end and a concave underside 54. The torsion spring 40 biases the hammer 23 forwardly against the hammer block 39. The torsion spring 37 biases the hammer block 39 rearwardly against the hammer 23. The concave underside 54 of the retaining finger 52 traps the hammer block 39 at its rounded end 47, as shown in FIG. 2, thereby holding the hammer block 39 in its rearward position and prevents the trigger 22 from being pulled rearwardly. In the neutral forward position, as shown in FIG. 2, the rearward movement of the trigger 22 is limited by the lip 48 at the outer end of the hammer block 39 striking the concave underside 54 of the retaining finger 52 thereby preventing any further rearward movement of the trigger 22. Therefore, the firearm cannot be fired by pulling the trigger 22 alone.

Rearward movement of the hammer 23 from the intermediate position, shown in FIG. 2, to the cocked position, shown in FIG. 3, causes the actuator finger 51 to engage the rearwardly facing surface 45 of the hammer block 39, and causes the hammer block 39 to swing forwardly and the trigger 22 to swing rearwardly. The hammer 23 has a cam notch 55 which is rearwardly situated of the actuator finger 51. When the hammer moves rearwardly toward its cocked position, the cam notch 55 cooperatively engages a fixed hammer stop pin 21 thereby limiting the rearward travel of the hammer 23, as shown in FIG. 3. When the hammer 23 is in its most rearward position, the actuator finger 51 engages notch 46 on the hammer block 39. This maintains the hammer in the rearward or cocked position, as shown in FIG. 3. When the hammer 23 is in the cocked position, the trigger 22 is in the intermediate position and is prevented from moving forwardly by the actuator finger 51 which is firmly seated in notch 46 through the biasing action of torsion spring 37. The firearm 10 is, thereby, cocked and ready to fire, as shown in FIG. 3. When the cocked hammer 23 is properly released by moving the trigger 22 rearwardly, the hammer 23 moves from its cocked position to its firing position thereby engaging the firing pin 24 with the striking surface 49, as shown in FIG. 4. This action causes the hammer block 39 to move forwardly so that the notch 46 pulls away from the actuator finger 51, thereby releasing the hammer 23 for forward motion by the torsion spring 40. When the trigger 22 is pulled back to its rearward position, the hammer block 39 is sufficiently forward so that it is clear of the hammer 23 when the hammer 23 moves to its forward firing position, as shown in FIG. 4.

When the barrel is in the open load position, as shown in FIG. 6, the rearward cavity 33 of breech plug 32 is exposed for receiving the primer. The outside surface of the breech plug has external threads 66 which mate with corresponding internal threads in the breech thereby enabling the breech plug to be screwed into the breech of the muzzle-loading firearm 10. The rearward end of the breech plug 32 has a fixture 67 for enabling the breech plug to be screwed into the breech of the firearm. The fixture 67 includes a hexagonal surface for receiving a wrench for tightening or loosening the breech plug as it is either inserted or removed from the breech. After the primer is inserted into the rearward cavity 33 of the breech plug chamber, the lever 13 is moved rearward and upward to close the breechblock 12, as shown in FIG. 2. The lever 13 has a protuberance 34 extending upwardly which limits the travel of the lever 13 by cooperatively engaging a fixed horizontal pin 21 on the breechblock 12 when the firearm 10 is in the locked position, as shown in FIGS. 2–4. After the muzzle-loading firearm 10 is loaded with powder and projectile in the usual manner and the primer is suitably positioned in the cavity 33, the trigger 22 is activated to release the hammer 23. When the hammer 23 reaches the firing position, as shown in FIG. 4, the striker surface 49 strikes the rearward end of the firing pin 24 and pushes the forward end of the firing pin 24 towards the breech plug 32. The sharp movement of the firing pin 24 towards the breech plug 32 enables the firing pin 24 to strike the primer, which is positioned within the cavity 33 of breech plug 32, thereby igniting a charge in the primer and causing a discharge of burning gas to enter a forwardly directed fire channel of the breech plug 32 causing it to ignite the powder charge in the powder chamber of barrel 17. When the trigger 22 is released after firing of the firearm 10, the rounded outer surface 47 of the hammer block 39 engages the rounded surface 53 of the retaining finger 52. The torsion spring 37 acting on the hammer block 39 is able to overcome the biasing influence of torsion spring 40 acting on the hammer 23 and pushes the hammer 23 rearwardly. The rounded surface 47 is rearward of the pivot pin 35 so that rearward movement of the hammer block 39 causes the rounded surface 47 to move downwardly. The rounded surface 53 of the retainer finger 52 is forward of the pivot pin 36 so that rearward movement of the retainer finger 52 causes the rounded surface 53 to move upwardly. As the hammer block 39 and the hammer 23 move rearwardly, the rounded surfaces 47 and 53 slide by each other until the lip 48 drops below the retaining finger 52, as shown in FIG. 2. Concurrently, the rearward movement of the striker surface 49 of the hammer 23 allows the biasing action of the helical compression spring 56 to move the firing pin 24 rearwardly beyond the rearward surface 31A of the breechblock 12, as shown in FIG. 2. The firearm is now in a condition for removing the discharged primer from the breech plug 32 by first manually moving the lever 13 forwardly and downwardly thereby moving the pivotal breechblock 12 rearwardly and downwardly through linkage 28 away from the breech-end 15 of the barrel 17 thereby placing the position, as shown in FIG. 6. The open breech-end of the barrel exposes the discharged primer for easy extraction from the breech plug cavity 32.

Referring to FIG. 3 and FIG. 5, the rear of trigger 22 has attached a tongue 43 extending downwardly and forwardly in a curved line, and terminating in a point, so as to form a cam. The tongue 43 has an upwardly facing concave notch 44. The cam portion of the tongue 43 limits the travel of the trigger 22 by cooperatively engaging a fixed horizontal pin 26 on the lever 13 thereby preventing the hammer 23 to be cocked unless the pivotal breechblock 12 is in its fully closed and securely locked position. When the hammer 23 is inadvertently cocked in the breechblock 12 fully open position, the tongue 43 engages pin 26 thereby preventing the rearward movement of trigger 22 and preventing the firing of the firearm 10. The force, exerted by the fixed horizontal pin 26 against the tongue 43, is communicated to the hammer block 39 thereby preventing the hammer to move from the cocked position to the firing position when the pivotal breechblock is open. When the hammer 23 is moved to its cocked position, as shown in FIG. 3, the upwardly facing concave notch 44 of the trigger 22 moves rearwardly under the fixed horizontal pin 26 thereby preventing the forward and downward movement of the lever 13 so that breechblock 12 remains securely locked.

Figure 7C:
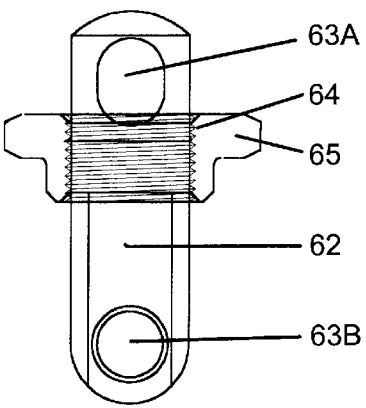
FIG. 7*c* view similar to FIG. 5 showing an adjustable link pivotally connecting the breechblock and the guard lever made adjustable by utilizing a locking hex nut.
Figure 7B:
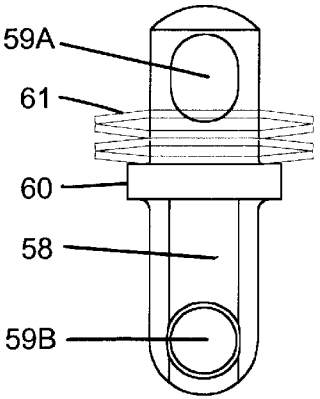
FIG. 7*b* is a view similar to FIG. 2 showing an adjustable link pivotally connecting the breechblock and the guard lever made adjustable by utilizing of a set of spring spacers.
Figure 7A:
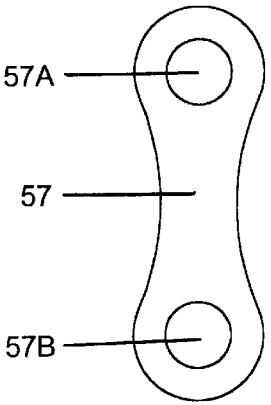
FIG. 7*a* is a view similar to FIG. 2 showing a solid nonadjustable link pivotally connecting the breechblock and the guard lever.
Figure 7D:
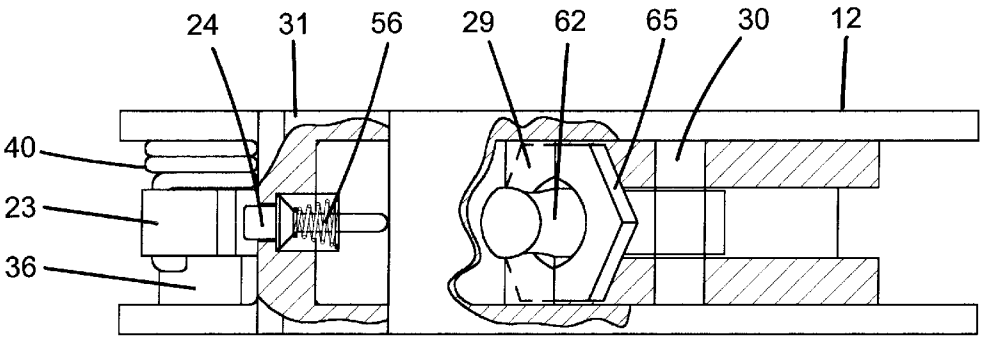
FIG. 7*d* is a horizontal fragmentary top view of the muzzle loading firearm with portions broken away and showing an adjustable link utilizing a hex nut to adjust the distance between the breechblock and the guard lever and which is locked in position between the inner surfaces of the side members of the breechblock.
Figure 8A:
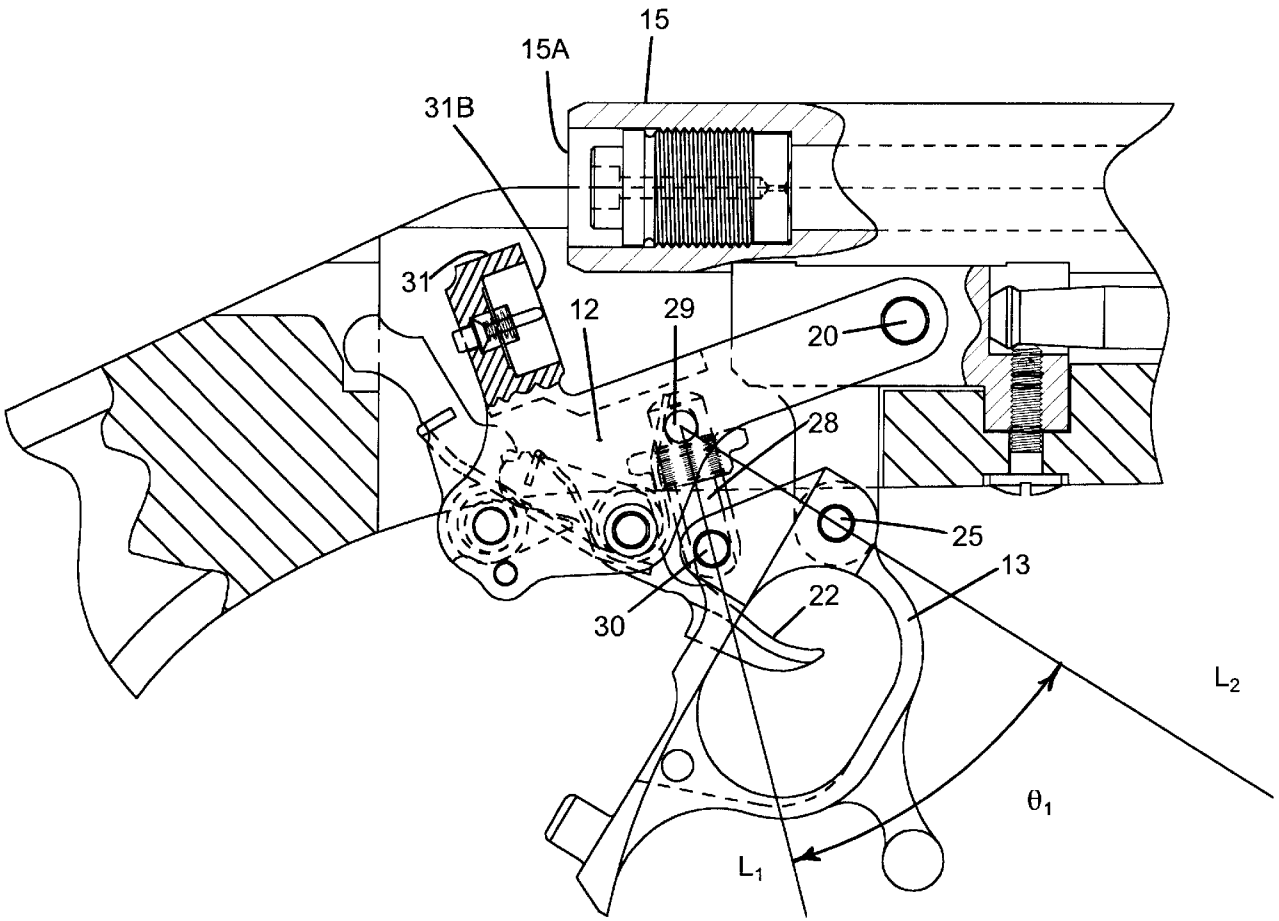
FIG. 8*a* is a view similar to FIG. 6 showing an angle $\theta_1$ generated by two lines having their vertex at the center of the pivot pin mounting the link on the breechblock when the breechblock is in its fully open load position, the center line ($L_1$), passing through the center of the pivot pin mounting the link on the guard lever, is rearward of the line ($L_2$) passing through the center of the pivot pin mounting the guard lever on the barrel lug.
Figure 8B:
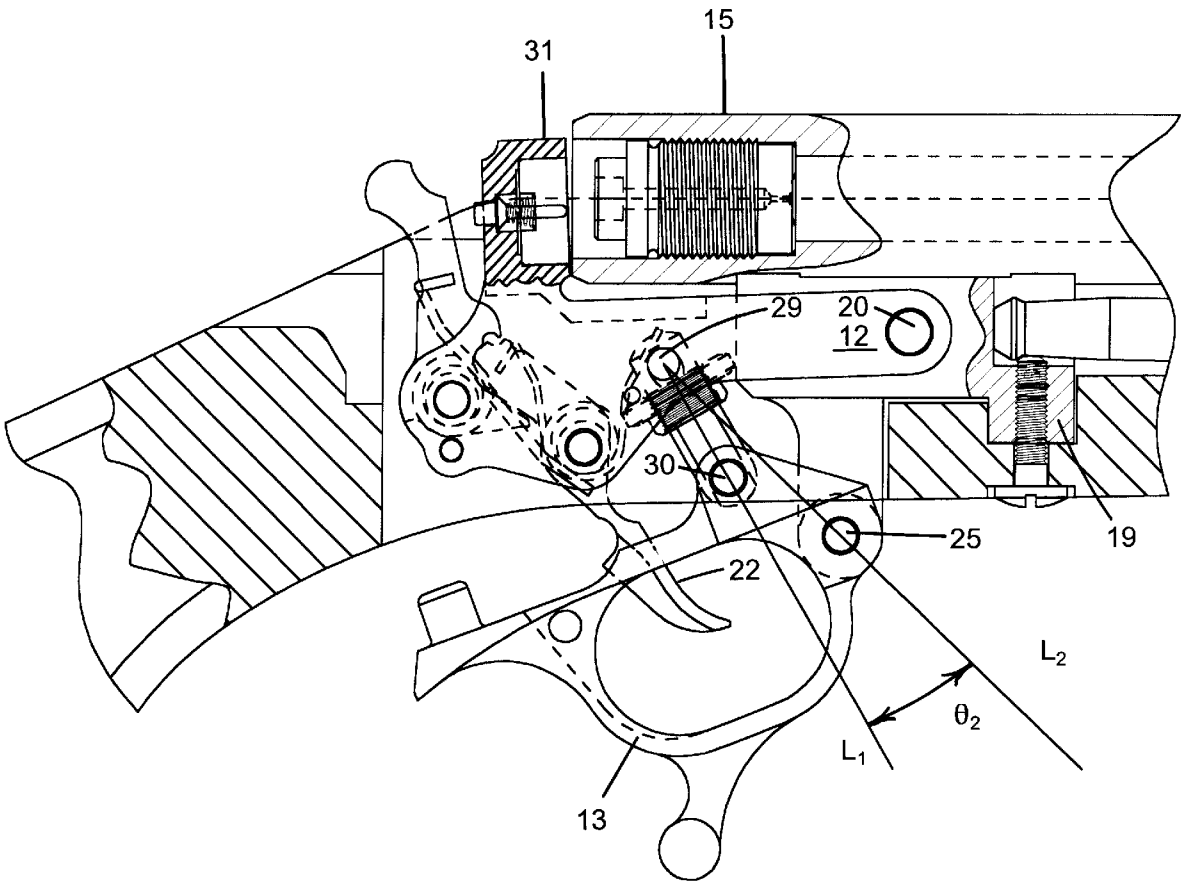
FIG. 8*b* is a view similar to FIG. 5 showing an angle $\theta_2$ generated by two lines having their vertex at the center of the pivot pin mounting the link on the breechblock when the breechblock is in its partially open position, the center line ($L_1$), passing through the center of the pivot pin mounting the link on the guard lever, is rearward of the line ($L_2$) passing through the center of the pivot pin mounting the guard lever on the barrel lug.
Figure 8C:
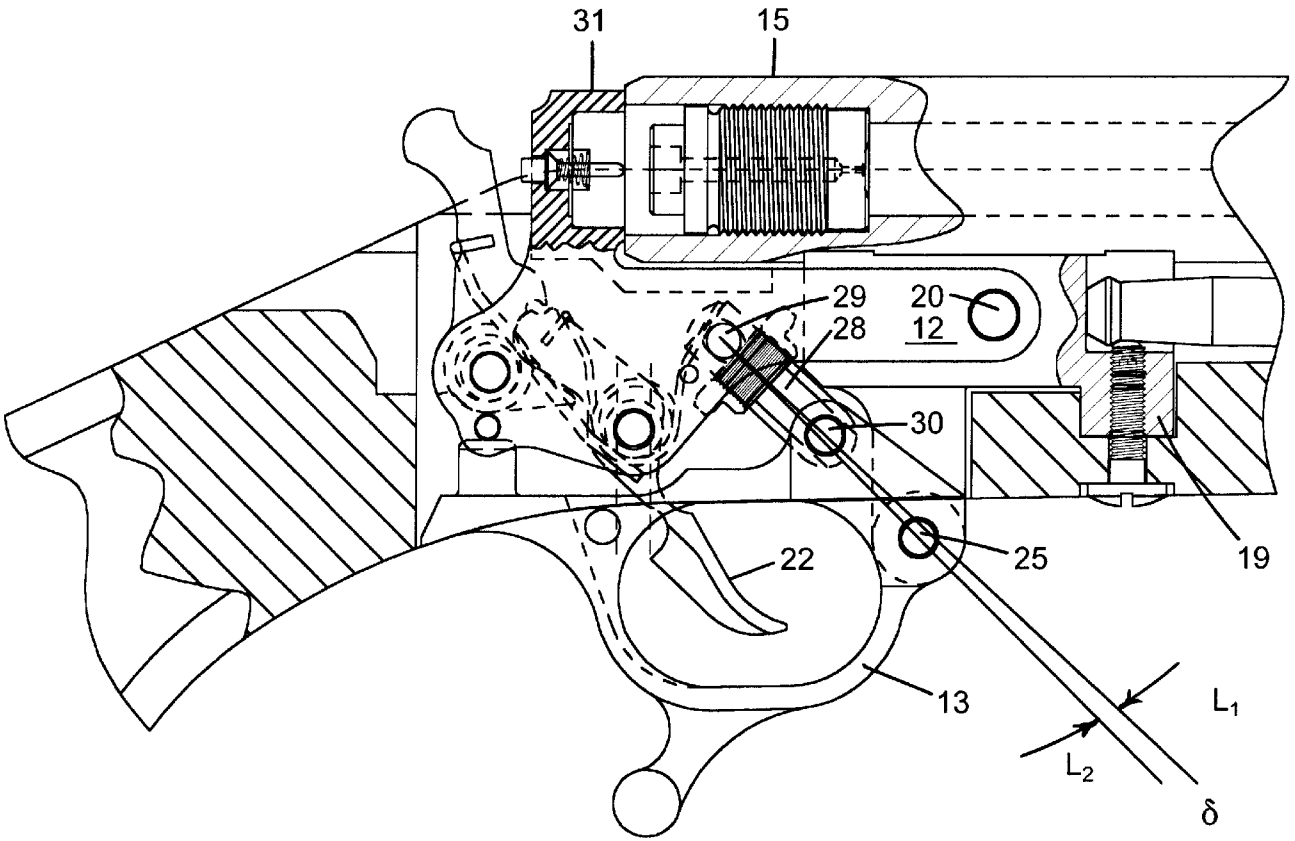
FIG. 8*c* is a view similar to FIG. 2 showing an angle $\delta$ generated by two lines having their vertex at the center of the pivot pin mounting the link on the breechblock when the breechblock is in its fully closed and locked position, the line center ($L_1$), passing through the center of the pivot pin mounting the link on the guard lever, is forward of the line ($L_2$) passing through the center of the pivot pin mounting the guard lever on the barrel lug.

Linkage 28 operates optimally by having a predetermined distance between the pivot pin 29 and the pivot pin 30. An optimum predetermined distance can be achieved by utilizing a number of different types of linkages 28. For example, without limiting the extent of the invention, the optimum predetermined distance d between the pivot pin 29 and the pivot pin 30 can be achieved by utilizing a nonadjustable link 57 having a circular opening 57A at one end for mounting on the breechblock and a cylindrical opening 57B on the other end for mounting on the lever. Opening 57A and opening 57B are separated by an optimum predetermined distance $d_1$, as shown in FIG. 7A. As another example, the optimum predetermined distance d can be achieved by utilizing a type of adjustable link 58, as shown in FIG. 7B. The adjustable link 58 has an elongated opening 59A for mounting on the breechblock 12 and a cylindrical opening 59B for mounting on the lever 13. Link 58 has a shoulder 60 to support a plurality of spring spacers 61 that are inserted coaxially on the link 58. The plurality of spacers 61 are utilized for a resultant optimum predetermined distance $d_2$, as indicated in FIG. 7B. As another example, the optimum inner predetermined distance d can be achieved by an adjustable link 62 having an elongated opening 63A for mounting on the breechblock 12 and a cylindrical opening 63B for mounting on the lever 13. Link 62 has a threaded portion 64 for coaxially accepting a hex nut 65, as shown in FIG. 7C. Hex nut 65 is adjusted on link 62 to attain an optimum predetermined distance $d_3$, as indicated in FIG. 7C. The inner surfaces of the side structure of the breechblock 12 are utilized to lock the hex nut in its position at the optimum predetermined distance $d_3$, as shown in FIG. 7D. In the present invention, it is intended that $d_1$, $d_2$, and $d_3$ are the optimum predetermined distances between the pivot pin 29 and the pivot pin 30 for utilizing a linkage pivotally connected to the lever 13 and to the breechblock 12 for locking and opening the breechblock 12. The locking of the breechblock, as the lever exerts a variable compressive and tensile force on the link 28 as it traverses through a maximum excursion along its length, can be more fully described with reference to FIGS. 8A–8C. When the breechblock is in its open or partially open position, a positive angle θ is generated by two lines with the vertex at the center of pivot pin 29. The center line, $L_1$, is a line connecting the vertex and the center of pivot pin 30. The terminal line, $L_2$, is a line connecting the vertex and the center of pivot pin 25. The angle $\theta_1$ is the angle generated by the two lines when the breechblock 12 is in the open position when the center line, $L_1$, is rearward of the terminal line, $L_2$, as shown in FIG. 8A. The angle $\theta_2$ is the angle generated by the two lines when the breechblock 12 is in the partially open position when the center line, $L_1$, is rearward of the terminal line, $L_2$, as shown in FIG. 8B. The angle $\theta_1$ is always greater than the angle $\theta_2$. When the breechblock 12 is moved from the open position to the securely locked position, the center line, $L_1$, is moved forward of the terminal line, $L_2$, forcing link 28 to an over-center-lock position, as shown in FIG. 8C. When link 28 is in the over-center-lock position, the center line, $L_1$, is forward of the terminal line, $L_2$. The change in positive angle $\theta$ to negative angle $\delta$, describes the movement of link 28 as the breechblock is caused to move from the open position to the over-center-lock position as the lever 13 exerts a variable compressive and tensile force on link 28. A firing force vectorially directed against the breechblock surface 31B increases the strength of the over-center-lock position of link 28. When the link 28 is in the over-center-lock position, the forces necessary to unlock the link 28 by forcing the lever 13 downward would be substantially greater in magnitude than the firing forces generated by the combined ignition of the primer and powder charge in the barrel 17 of the muzzle loader firearm 10.

Figure 9:
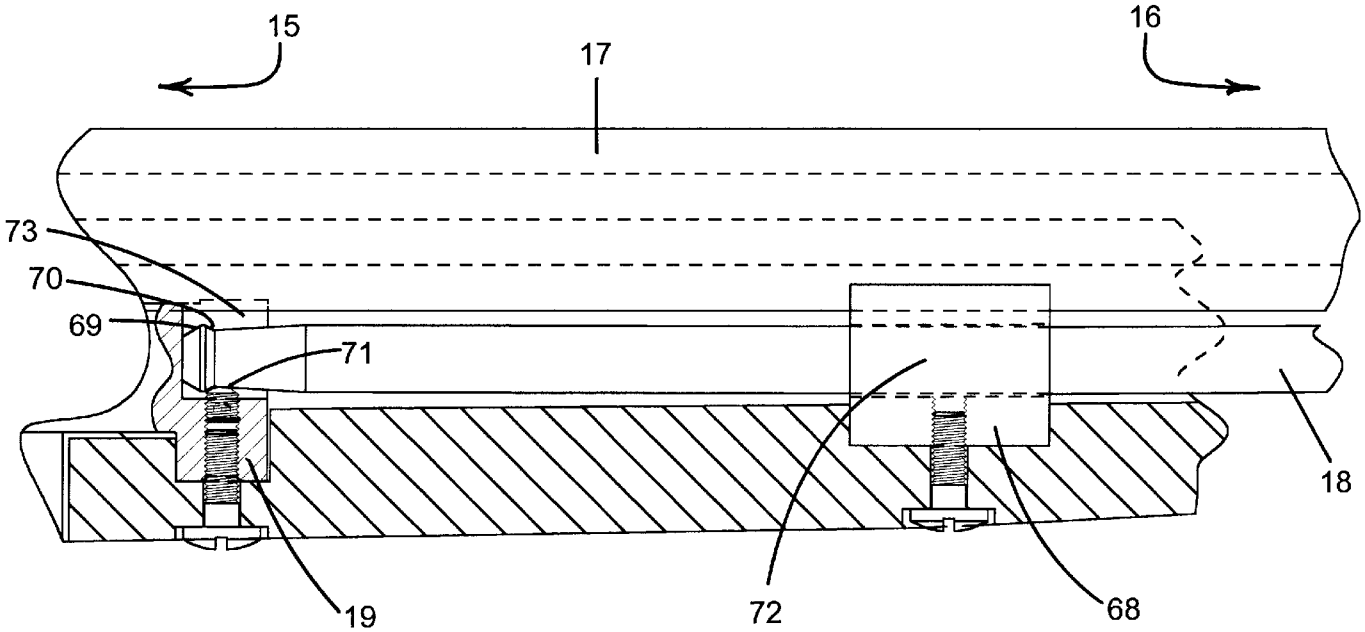
FIG. 9 is a longitudinal vertical fragmentary right side elevational view of the muzzle loading firearm with portions broken away and showing the ramrod tensionally locked in the cylindrical opening of the main rear barrel lug by a recessed screw and showing the mounting screws for securing the stock to the barrel lugs.

With reference to FIG. 9, the ramrod 18 has a front end with a threaded tapered tip 69 for incorporating cleaning and maintenance accessories and has a tapered recess 70 for accommodating cleaning patches. The barrel 17 has the rearward main barrel lug 19 and a forward secondary barrel lug 68 for mounting the stock 11. The forward secondary barrel lug 68 has a horizontal inner cylindrical opening which defines the longitudinal bore 72 into which the ramrod is slidably inserted. The main barrel lug 19 has a forwardly facing horizontal cylindrical cavity 73 of sufficient depth and longitudinal bore to receive and retain the front end of the ramrod. A screw with oval head 71 protrudes through the forwardly facing bore of the barrel lug 19 over which the tip 69 of the ramrod slides as it is pushed rearwardly into the bore of the barrel lug 19. The ramrod is retained in the cylindrical cavity of barrel lug 19 by its inherent elasticity oppositely balanced by a compression force exerted by the screw 71 against the surface of the tapered recess 70 of the ramrod. The compression force applied to the tapered recess 70 of the ramrod can be adjusted by a predetermined protrusion of the oval head of the screw 71 in the barrel lug 19.

Breechblock 12, triggerguard lever 13, firing mechanism assembly 14, pins 20, 25, 26, 29, 30, 35, 36, link 28, front end of ramrod 18, and screw 71 are preferably made of steel or other hard material for strength, for wear reduction, and avoidance of dimensional distortion. The breech plug 32 is preferably made of a stainless steel for corrosion avoidance.

LIST OF REFERENCE NUMERALS ON DRAWINGS

10 Lever-operated muzzle-loading firearm in general
11 Stock in general
12 Lever-operated rearward and downward breechblock
13 Triggerguard actuating lever
14 Firing mechanism assembly in general
15 Breech-end of barrel
15A Lock surface on breech-end of barrel for sealing with breechblock
16 Muzzle-end of barrel
17 Barrel in general
18 Ramrod in general
19 Rearward barrel lug
20 Pivot pin about which breechblock rotates on rearward barrel lug
21 Stop on breechblock for engaging cam notch on hammer and lever
22 Trigger
23 Hammer
24 Firing pin
25 Pivot pin about which lever rotates on rearward barrel lug
26 Interlock pin on triggerguard for engaging curved tongue on trigger
27 Finger grip for rotating lever to an open and locked position
28 Connecting link in general between lever and breechblock
29 Pivot pin for mounting link on breechblock
30 Pivot pin for mounting link on lever
31 Firing pin housing on breechblock
31A Rearward surface of firing pin housing
31B Forward lock surface of firing pin housing
32 Breech plug
33 Cavity in breech plug for receiving a primer
34 Protuberance on triggerguard extending upwardly for lever stop
35 Pivot pin about which the trigger rotates on breechblock
36 Pivot pin about which the hammer rotates on breechblock
37 Torsion spring for forwardly biasing the trigger
38 Notch on hammer block for engaging torsion spring
39 Hammer block
40 Torsion spring for forwardly biasing the hammer
41 Rearwardly facing notch on hammer for engaging torsion spring
42 Rearwardly facing surface on hammer
43 Curved tongue rearwardly attached to trigger
44 Upwardly facing concave notch on curved tongue of trigger
45 Rearwardly facing surface on hammer block
46 Rearwardly facing notch on hammer block
47 Rounded convex surface on upper portion of hammer block
48 Lip on upper portion of hammer block
49 Striking surface on hammer for engaging firing pin
50 Thumb grip on hammer
51 Actuator finger on hammer
52 Retaining finger on hammer
53 Rounded convex surface on the hammer retaining finger
54 Concave underside on the hammer retaining finger
55 Cam notch on hammer for engaging stop
56 Helical compression spring rearwardly biasing firing pin
57 Solid nonadjustable link with cylindrical openings
57A Cylindrical opening for mounting on breechblock
57B Cylindrical opening for mounting on lever
58 Adjustable link with resilient disc spacers
59A Elongated opening on adjustable link for mounting on breechblock
59B Cylindrical opening on adjustable link for mounting on lever
60 Shoulder on adjustable link
61 Resilient disc spacers
62 Adjustable link with hex nut
63A Elongated opening on adjustable link for mounting on breechblock
63B Cylindrical opening on adjustable link for mounting on lever
64 Threaded portion on link
65 Hex nut on link
66 Outer threads on breech plug
67 Fixture for screwing breech plug into breech
68 Forward secondary barrel lug
69 Tip on ramrod
70 Tapered recess on ramrod
71 Oval head of recessed screw 72 Longitudinal cylindrical opening on forward secondary barrel lug 73 Longitudinal cylindrical cavity on rearward barrel lug The embodiments of the invention in which we claim an exclusive property or privilege are as follows:

1. In a lever-operated muzzle-loading firearm comprising:

a) a stock for manipulating the firearm and a barrel having a bore extending therethrough, the barrel bore having a breech-end and a muzzle-end, the breech-end of the barrel supporting a removable chamber having a rearward cavity for positioning a primer;

b) a rearward barrel lug attached to the barrel for supporting a rotatable breechblock and a rotatable lever;

c) a pin mounted on the barrel lug about which the breechblock pivots rearwardly and downwardly from a locked position to an open position;

d) a pin mounted on the barrel lug about which the lever pivots for moving the breechblock from the locked position to the open position;

e) linking means for connecting the lever and the breechblock to permit the breechblock to be moved by the lever rearward and downward from the locked position to the open position and for the breechblock to be moved upward and forward from the open position to the locked position;

f) a firing mechanism supported on the breechblock having a trigger, a hammer, and a firing pin assembly for detonating the primer and discharging the firearm;

g) a ramrod for facilitating loading of a powder charge and a projectile; and h) a storing means for carrying the ramrod with the firearm.

2. The lever-operated muzzle-loading firearm of claim 1, wherein said linking means comprises:

a) a pivot pin on the breechblock and a pivot pin on the lever;

b) a link having a cylindrical opening at each end of the link with one end mounted on the pivot pin on the breechblock and the other end mounted on the pivot pin on the lever;

c) a center line between the pivot pin on the breechblock and the pivot pin on the lever pivot when the breechblock is in its locked position;

d) a terminal line between the pivot pin on the breechblock and the pivot pin on the barrel lug about which the lever pivots to open and lock the breechblock; and e) the link and lever being so configured that a breech-end lock surface and a complementary breechblock lock surface engage under forces of the lever in the locked position to resist movement of the link and lever through such centerline from a position forward of such terminal line to a position rearward of such terminal line.

3. The lever-operated muzzle-loading firearm recited in claim 2, wherein the link further comprises:

a) an elongated slot in the link to receive the pivot pin on the breechblock;

b) a cylindrical opening in the link to receive pivot pin on the lever; and c) means for adjusting the length of the elongated slot in the link for a predetermined distance between the lever and the breechblock.

4. The lever-operated muzzle-loading firearm as recited in claim 3, wherein said means for adjusting the length of the elongated slot comprises:

a) a link having a shoulder which is interposed between said elongated slot and said cylindrical opening;

b) a resilient disc having a hole in the center thereof for coaxially mounting, said disc on said shoulder of said link; and c) a plurality of said discs mounted on said shoulder of said link for a predetermined distance between said lever and said breechblock.

5. The lever-operated muzzle-loading firearm as recited in claim 3, wherein said means for adjusting the length of the elongated slot comprises:

a) a link having a screw thread interposed between said elongated slot and said cylindrical opening in the link for receiving a hexagonal nut having a complementary thread;

b) said hexagonal nut screwed on said thread for a predetermined distance between said lever and said breechblock; and c) locking means for said hexagonal nut for preventing rotation away from said predetermined distance between said lever and said breechblock.

6. The lever-operated muzzle-loading firearm of claim 1, wherein the firing mechanism assembly comprises:

a) a trigger which is pivotally connected for rotation on the breechblock by a pin at a first pivot point about which the trigger pivots relative to the breechblock between a forward neutral position and a rearward firing position;

b) first biasing means for biasing said trigger toward said forward position;

c) a hammer block which is fixed to said trigger and which extends from said first pivot point in the opposite direction from said trigger so that when said trigger is in said forward neutral position, the hammer block is in a rearward position and when said trigger is in said rearward firing position, the hammer block is in a forward position;

d) a hammer which is pivotally connected for rotation on the breechblock at a second pivot point which is rearward of said trigger first pivot point by a pin about which the hammer pivots relative to the breechblock between a rearward cocked position and a forward firing position, said hammer engaging said hammer block when said hammer block is in its rearward position and said trigger is in its forward position and said hammer is in an intermediate position between said rearward cocked position and said forward firing position to prevent said hammer from reaching said forward firing position;

e) second means for biasing the hammer in a forward firing position;

f) an actuator which is fixed to said hammer and which extends from said second pivot point in the opposite direction from said hammer for engaging said hammer block and moving said hammer block forwardly and moving said trigger rearwardly to an intermediate position between the forward and rearward positions of said trigger when said hammer is moved to its rearward cocked position;

g) a cam notch fixed to said hammer extending rearwardly from said second pivot point for engaging a cross member fixed to the breechblock for limiting the rearward movement of the hammer when said hammer is moved to its rearward cocked position, said cam notch occupying a stopping position when said hammer is in its cocked position and said cam notch occupying a clear position when said hammer is in its neutral and firing position;

h) latching means associated with said hammer block and said actuator for locking said hammer in its rearward position against forward motion and said trigger in its intermediate position against forward motion, said latching means being rendered ineffective to lock said hammer in its rearward position upon movement of said trigger to its rearward position so that said hammer is moved to its forward firing position by said second biasing means;

i) a forwardly facing striker surface on said hammer for engaging a firing pin when said hammer is in said forward firing position;

j) said firing pin slidably supported on the breechblock and coaxially aligned with the primer-receiving cavity and one end biased rearwardly by a helical compression spring so that the firing pin extends rearward of the breechblock housing for engaging said striker surface when said hammer is in the firing position.

7. The lever-operated muzzle-loading firearm recited in claim 6, wherein the first biasing means comprises a torsion spring for biasing the trigger in the forward position which is centrally supported on the breechblock by the pin about which the trigger pivots, one end of the torsion spring engaging the upper forward portion of the hammer block and the other end of the torsion spring being supported by the breechblock pivot pin on which one end of the link connecting the breechblock and the lever is mounted.

8. The lever-operated muzzle-loading firearm recited in claim 6, wherein the second biasing means comprises a torsion spring for biasing said hammer in the forward firing position which is centrally supported on the breechblock by the pin about which the hammer pivots, one end of the spring rearwardly engaging the hammer above the second pivot point and the other end of the torsion spring engaging the pin about which the trigger pivots at the first pivot point.

9. The lever-operated muzzle-loading firearm recited in claim 6, wherein said latching means comprises:

a) a rearwardly facing notch on one side of said hammer block; and b) a projection on said actuator which is fixed to said hammer for engaging said notch when said hammer is in its rearward cocked position and when said trigger is in its intermediate position, said projection being clear of said notch when said trigger is moved rearwardly from its intermediate position.

10. The lever-operated muzzle-loading firearm recited in claim 6, wherein said hammer further comprises a retaining finger which occupies a retaining position for preventing said hammer block from moving forwardly and said trigger from moving rearwardly when said hammer block is in its rearward position, said retaining finger being moved out of engagement of said retaining position with said hammer block when said hammer block is moved forwardly by said actuator to permit rearward movement of said trigger when said hammer is moved rearwardly to said cocked position.

11. The lever-operated muzzle-loading firearm of claim 6, wherein said trigger further comprises:

a) a downward extension from said first pivot point;

b) a tongue having a predetermined curvature rearwardly attached to said trigger for limiting the rearward movement of said trigger; and c) a finger on said tongue for preventing movement of said lever when said hammer is in said cocked position.

12. The lever-operated muzzle-loading firearm of claim 1, wherein said lever further comprises:

a) a trigger guard having a protuberance for manually rotating said lever;

b) a rearwardly mounted fixed interlock member for engaging said curvature on said tongue on trigger for preventing rearward movement of said hammer toward its cocking position when said lever and said breechblock are in said open position and for engaging said finger on said tongue for preventing downward movement of said lever when said hammer is in said cocked position; and c) a protuberance rearwardly fixed to said trigger guard, said protuberance extending upwardly for engaging said cross member fixed to said breechblock for stopping upward movement of said lever when said breechblock is in its locked position.

13. The lever-operated muzzle-loading firearm of claim 1, wherein said ramrod further comprises a tip consisting of a front end and a concave tapered recess.

14. The lever-operated muzzle-loading firearm of claim 1, wherein said means for storing said ramrod comprises:

a) said rearward barrel lug having a cylindrical cavity longitudinally parallel with said barrel and having a threaded opening for receiving a recessed screw having an oval head and a screw for supporting the stock;

b) a forward barrel lug consisting of a cylindrical hole coaxial with said cylindrical cavity;

c) a screw having an oval head perpendicularly aligned with the longitudinal axis of said cylindrical cavity of said rearward barrel lug and protruding a predetermined distance inside said cylindrical cavity; and d) tensionally retaining said concave tapered recess of said tip when said ramrod is slidably moved over said oval head of said screw.

15. In a method of discharging a muzzle-loader firearm having a barrel with a breech-end and incorporated therein a removable breech plug having a rearward cavity for positioning a primer and communicating via an ignition bore with an interior chamber in the barrel containing a muzzle-loaded powder charge and a projectile so that a detonation of the primer ignites the powder charge and propels the projectile by expansion of burning gases out the firearm, the method comprising the steps of:

a) providing a breechblock which is able to rotate from a breech-locking position to an open breech position for inserting said primer in said rearward cavity of said breech plug;

b) providing a lever means which is able to rotate said breechblock from said breech-locking position to said open breech position;

c) providing a locking means which operatively connects said breechblock and said lever for securing said breechblock in said breech-locking position;

d) providing a firing pin assembly for striking said primer and discharging said firearm;

e) coupling a trigger mechanism to a hammer mechanism for controlling actuation thereof for striking said firing pin assembly;

f) supporting said firing pin assembly, said trigger mechanism, and said hammer mechanism by said breechblock;

g) moving said breechblock rearwardly and downwardly by said lever to said open breech position and inserting said primer in said rearward cavity of said breech plug;

h) moving said breechblock upwardly and forwardly to said breech-locking position and moving said hammer rearwardly to a cocking position; and i) actuating said firing pin assembly by said trigger mechanism causing said primer to be detonated whereby said powder charge in said interior chamber is ignited propelling said projectile out said firearm.

* * * * *